United States Patent [19]

Williams et al.

[11] Patent Number: 5,023,582

[45] Date of Patent: Jun. 11, 1991

[54] MOLDED CASE CIRCUIT BREAKER COMPACT LATCH ASSSEMBLY

[75] Inventors: Laura A. Williams, Plainville; Gary D. Magnon, Bristol; Michael C. von Kannewurff, Middlebury; Raymond K. Seymour, Plainville, all of Conn.

[73] Assignee: General Electric Company, New York, N.Y.

[21] Appl. No.: 526,481

[22] Filed: May 21, 1990

[51] Int. Cl.[5] ..... H01H 9/20

[52] U.S. Cl. ..... 335/167; 335/172; 335/22

[58] Field of Search ..... 335/167–174, 335/22–26

[56] References Cited

U.S. PATENT DOCUMENTS

| | | | |
|---|---|---|---|
| 4,123,734 | 10/1931 | Maier et al. | 335/9 |
| 4,864,263 | 9/1989 | Castonguay et al. . | |
| 4,888,570 | 12/1989 | Toda | 335/167 |
| 4,951,020 | 8/1990 | Changle et al. | 335/174 |

*Primary Examiner*—Gerald P. Tolin
*Assistant Examiner*—Lincoln Donovan
*Attorney, Agent, or Firm*—Richard A. Menelly; Walter C. Bernkopf; Fred Jacob

[57] ABSTRACT

A molded case circuit breaker employs a multiple latch assembly for maintaining the circuit breaker operating mechanism in a closed condition. The multiple latch assembly includes three separate latch levers mounted on a common latch support frame. The multiple latch arrangement substantially reduces the amount of tripping force required to articulate the circuit breaker operating mechanism.

24 Claims, 7 Drawing Sheets

18

MOLDED CASE CIRCUIT BREAKER COMPACT LATCH ASSSEMBLY

BACKGROUND OF THE INVENTION

Industrial-rated circuit breakers are currently available having operating components that are designed for automatic assembly to provide cost improvement as well as improved operating efficiency. The precision alignment performed by the automated assembly equipment assembles the operating components within very close operating tolerances. An operating mechanism designed for down-loaded automated assembly is described in U.S. Pat. No. 4,864,263, which Patent is incorporated herein for reference purposes. The operating mechanism assembly includes a pair of operating springs that are overcentered for rapidly driving the movable contact arm and the attached movable contact away from the stationary fixed contact to interrupt the circuit current. The operating mechanism includes a cradle operator which engages a latch assembly to prevent the movable contact arm from being driven to its open position under the urgence of the charged operating springs. The compact latch assembly includes a primary and secondary latch operating within a common support structure.

With higher ampere-rated industrial circuit breaker designs, the correspondingly larger operating springs provide a substantially increased latching force to the cradle operator within the operating mechanism such that a correspondingly larger "tripping" force is required to unlatch the cradle operator and release the operating mechanism. An earlier circuit breaker operating mechanism design utilizes a supplemental tripping mechanism in combination with the circuit breaker tripping mechanism to provide sufficient tripping force to articulate the operating mechanism. One such supplemental tripping mechanism is described within U.S. patent application Ser. No. 518,673 filed May 3, 1990, which Patent Application is incorporated herein for reference purposes.

One purpose of the instant invention is to provide a multiple latch assembly whereby the tripping force required to articulate the circuit breaker operating mechanism is reduced by means of the multiple latch arrangement.

SUMMARY OF THE INVENTION

The invention comprises a primary, secondary and tertiary latch lever arrangement mounted on a common support frame for substantially reducing the amount of tripping force required to articulate a circuit breaker operating mechanism. The three latch levers simultaneously and automatically become reset during the manual resetting of the operating mechanism.

GENERAL DESCRIPTION OF THE INVENTION

Figure 1:
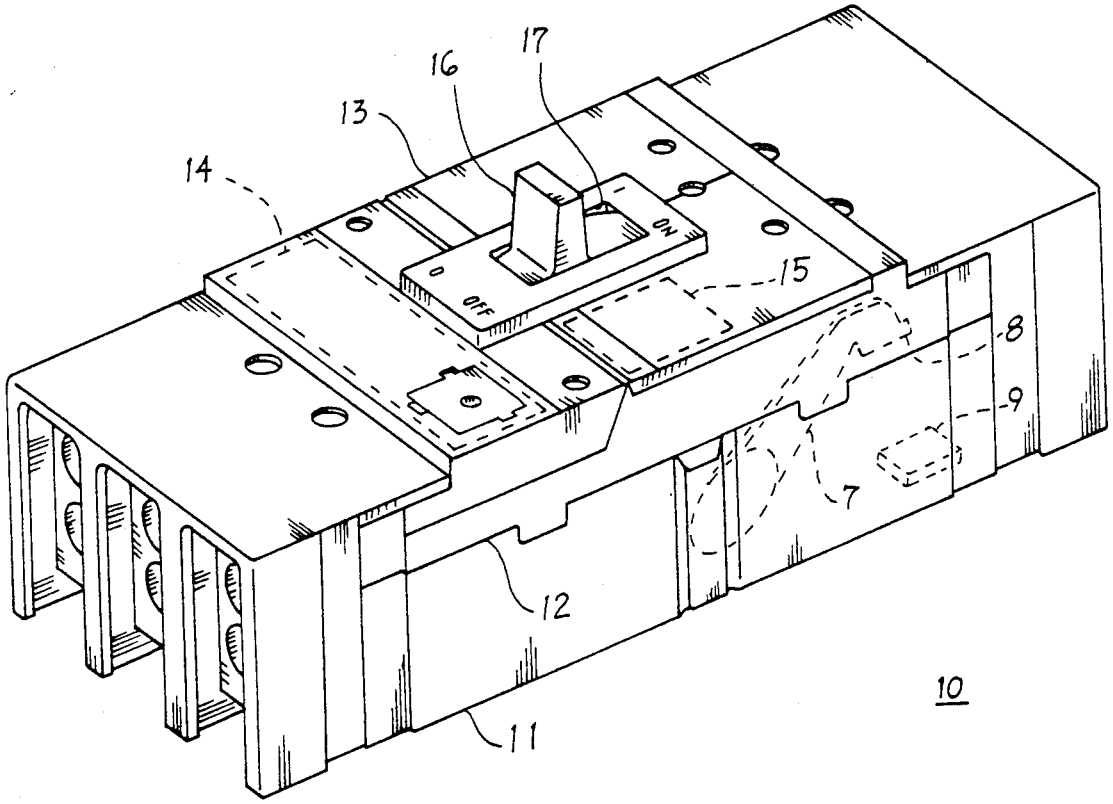
FIG. 1 is a top perspective view of a molded case circuit interrupter employing the multiple latch assembly in accordance with the invention.

As described within the aforementioned U.S. Pat. and Patent Application relating to circuit interrupter tripping and latching arrangements, the larger components used for higher current ampacity within the higher-rated circuits correspondingly require more powerful operating springs to immediately motivate these components upon the occurrence of an overcurrent condition. The use of a primary and secondary latch arrangement within the higher-rated circuit interrupters, restrains the circuit breaker operating mechanism from releasing and interrupting the circuit current in the absence of an overcurrent condition. This so-called "nuisance-tripping", whereby the circuit interrupter operating mechanism becomes articulated in the absence of a predetermined overcurrent condition could cause expensive manufacturing down-time when used within industrial power distribution circuits. The use of a supplemental tripping mechanism to overcome the additional tripping force required with the more powerful circuit interrupter operating spring is not feasible within compact circuit interrupter enclosures. The multi-latch arrangement of the instant invention utilizes a primary, secondary and tertiary latch to provide tripping force to the circuit breaker operating mechanism without incurring deleterious nuisance-tripping effects. The addition of a tertiary latch that interacts with the primary latch through a double-action torsion spring ensures that the circuit breaker operating mechanism automatically becomes latched in a single movement of the circuit breaker operating handle.

DESCRIPTION OF THE PREFERRED EMBODIMENT

A higher-rated circuit interrupter 10, as described earlier, is depicted in FIG. 1 and consists of a molded plastic case 11 to which a molded plastic cover 12 is fixedly secured. An accessory cover 13 is attached to the circuit interrupter cover and provides access to an electronic trip unit 14 and an actuator-accessory unit 15. An operating handle 16 extends through the circuit interrupter cover by means of an access slot 17 and provides manual intervention to turn the circuit interrupter contacts 8, 9 between their open and closed positions.

Figure 2:
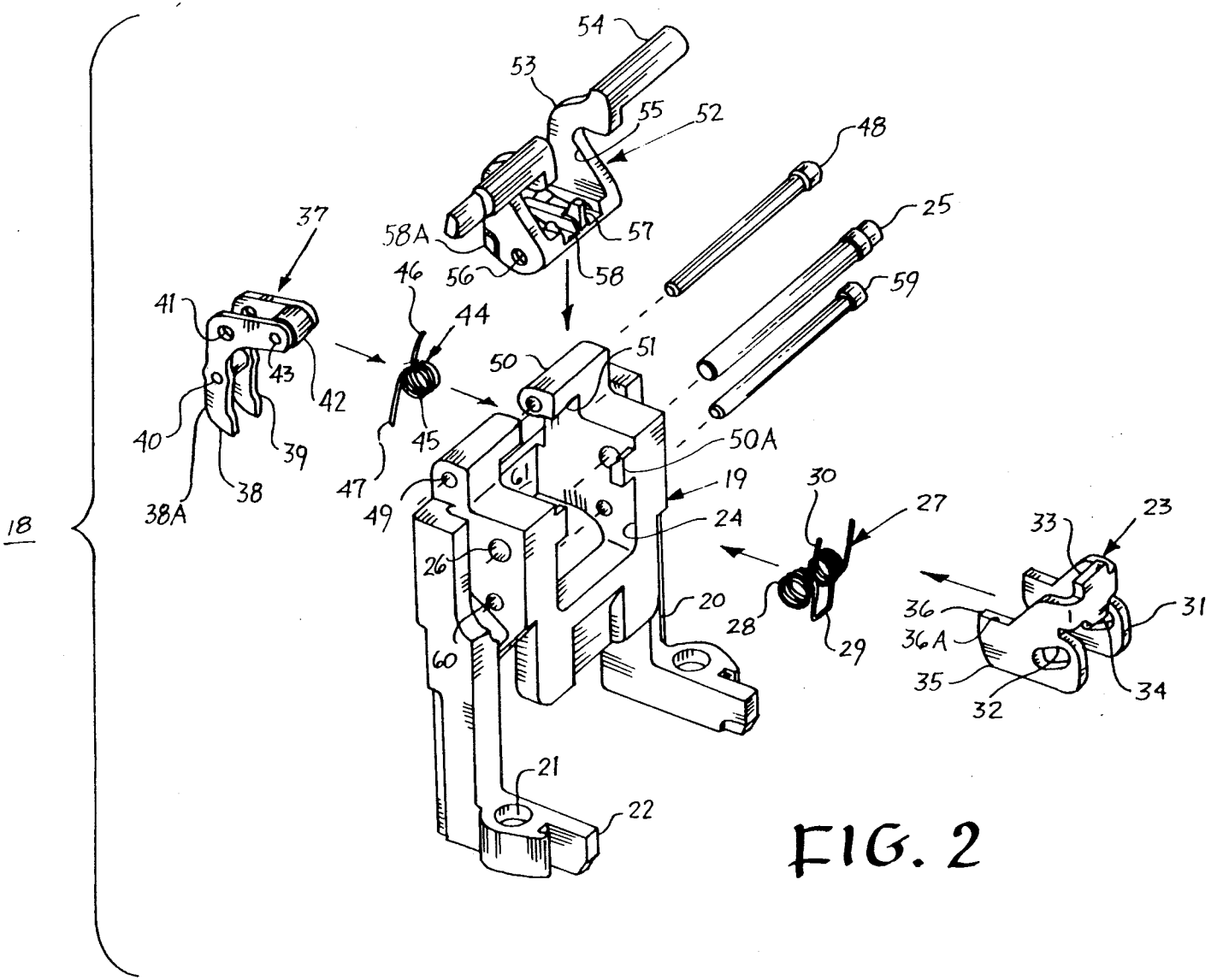
FIG. 2 is a top perspective view of the multiple latch assembly of the invention with the latch components depicted in isometric projection.

The multiple latch assembly 18 used within the circuit interrupter of FIG. 1 is depicted in FIG. 2 prior to assembly. A die-cast metal support frame 19 supports the multiple latch components and includes a pair of legs 20 that provide attachment to the circuit interrupter case by means of corresponding angulated ends 22 and thru-holes 21. A primary latch lever 23 which retains the circuit breaker cradle operator under the downwardly-extending tab 34 is positioned within the latch assembly recess 24 formed within the support frame. The primary latch lever is pivotally retained on the support frame by means of the primary latch pivot pin 25, elongated slots 32 formed through the sides 35 of the U-shaped body member 31 and thru-holes 26 formed through the sides of the support frame. Prior to insertion of the primary latch pivot pin 25 through the thru-holes 26, the double-action torsion spring 27 is arranged between the sides 35 and the cylindrical winding 28 is aligned with the elongated slots 32. The upwardly-extending ends 30 of the double-action torsion spring 27 are trapped behind the upwardly-extending tab 33 integrally-formed on the U-shaped body member 31 and provides return bias to the primary latch lever. The downwardly-extending loop 29 from the double-action torsion spring 27 interacts with the tertiary latch lever 52 in a manner to be described below in greater detail. The planar stops 36A on the top surface of the side extensions 36 on the primary latch lever 23 interact with the shelves 51 formed on the undersurface of the projections 50 on the support frame 19 to stop the rotation of the primary latch lever 23 against the bias provided by the double-action torsion spring 27. A secondary latch lever 37 contains a pair of V-shaped side pieces 38 with an intervening roller 42 supported by means of a pin 43 at one end and held together by means of a connector pin 40 at an opposite end. A secondary latch lever spring 44 including an upwardly-extending leg 46 and a downwardly-extending leg 47 from a cylindrical winding 45 is positioned intermediate the side pieces 38 before pivotally connecting the secondary latch lever to the support frame by means of the secondary latch lever pivot pin 48, thru-holes 41 in the side pieces and thru-holes 49 within the support frame. A pair of stops 39 formed on the bottom ends of the side pieces interact with the back surface 58A of the bottom 58 of the tertiary latch lever 52 limit the rotation of the secondary latch lever about the secondary latch lever pivot in one direction. The secondary latch lever 37 is biased in its rest position by the secondary latch lever spring 45 and is stopped against the back wall 61 of the support frame 19 by the back surfaces 38A of the side pieces 38 from rotation about the secondary latch lever pivot in an opposite direction. The tertiary latch lever 52 sits within the latch assembly recess 24 outboard the primary latch lever 23 and is positioned such that the extending sidearms 54 on the U-shaped body 53 stop against the projections 50 formed on the support frame 19. These projections also serve to position the secondary latch lever while projections 50A serve to locate and position the primary latch lever within the latch assembly recess. When the tertiary latch lever is pivotally arranged on the support frame by means of the tertiary latch lever pivot pin 59, thru-holes 56 on the tertiary latch lever and corresponding thru-holes 60 on the support frame, the primary latch lever 23 is constrained to rotate within the space 55 formed within the tertiary latch lever between the extending sidearms 54. The projection 57 formed on the bottom of the U-shaped body 53 captures the downwardly-extending loop 29 of the double-action torsion spring 27 and biases the sidearms 54 away from the projections 50 on the support frame 19 and against the primary latch lever pivot pin 25.

Figure 3:
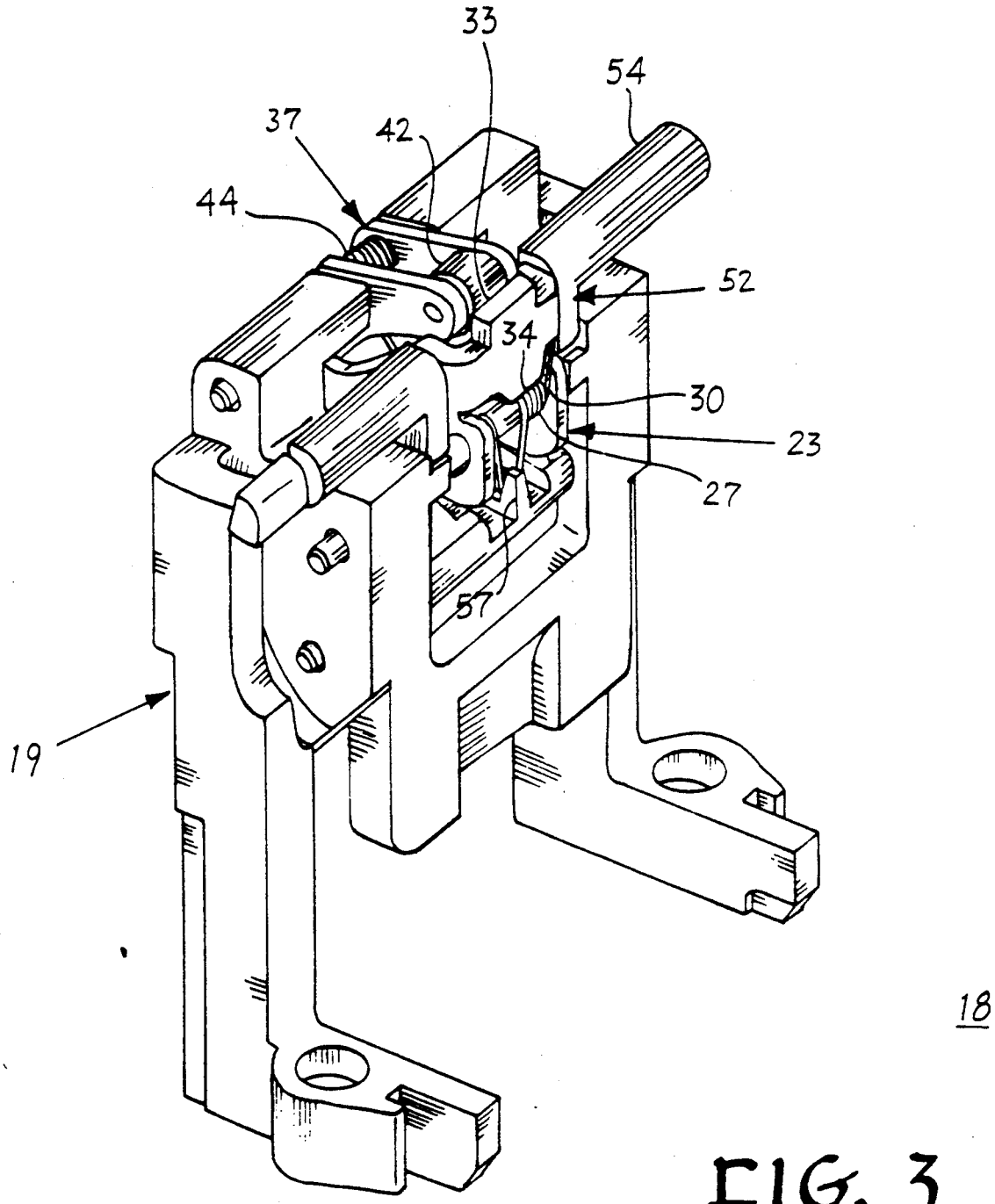
FIG. 3 is a top perspective view of the multiple latch assembly of FIG. 2 with the latch components arranged on a common support structure.

The multiple latch assembly 18 is depicted in FIG. 3 with the primary latch lever 23 arranged intermediate the secondary latch lever 37 and the tertiary latch lever 52 on the support frame 19. The multiple latch assembly is depicted in its "LATCHED" condition with the roller 42 in abutment with the upwardly-extending tab 33 and retained against the tab by means of the bias provided by the secondary latch lever spring 44. The so-called "latching force" which is the amount of force required to retain the circuit interrupter operating mechanism cradle operator under the downwardly-extending tab 34 is substantially increased by the abutment of the roller 42 with the upwardly-extending tab 33 and by means of the tension exerted by the upwardly-extending ends 30 of the double-action torsion spring 27 arranged against the projection 57 on the tertiary latch lever 52. The sidearms 54 interact with the circuit interrupter trip actuator to articulate the circuit interrupter operating mechanism and also to prevent the resetting of the circuit interrupter operating mechanism in the manner to be described below in greater detail.

Figure 4:
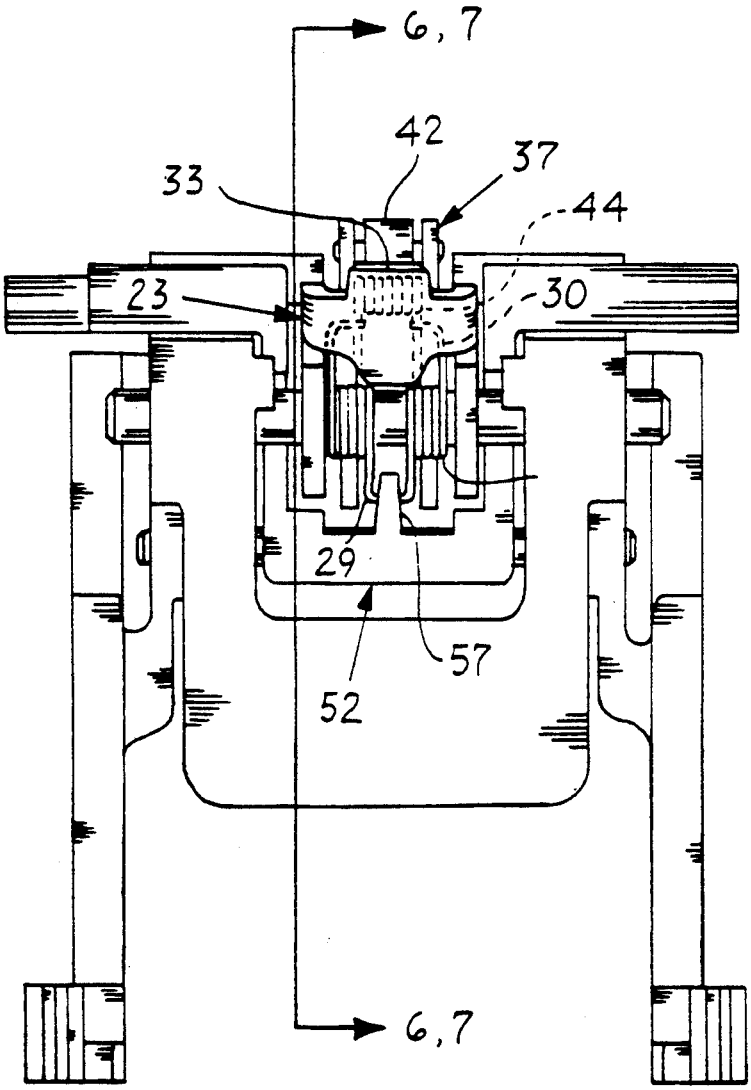
FIG. 4 is a front view of the latch assembly of FIG. 3.
Figure 5:
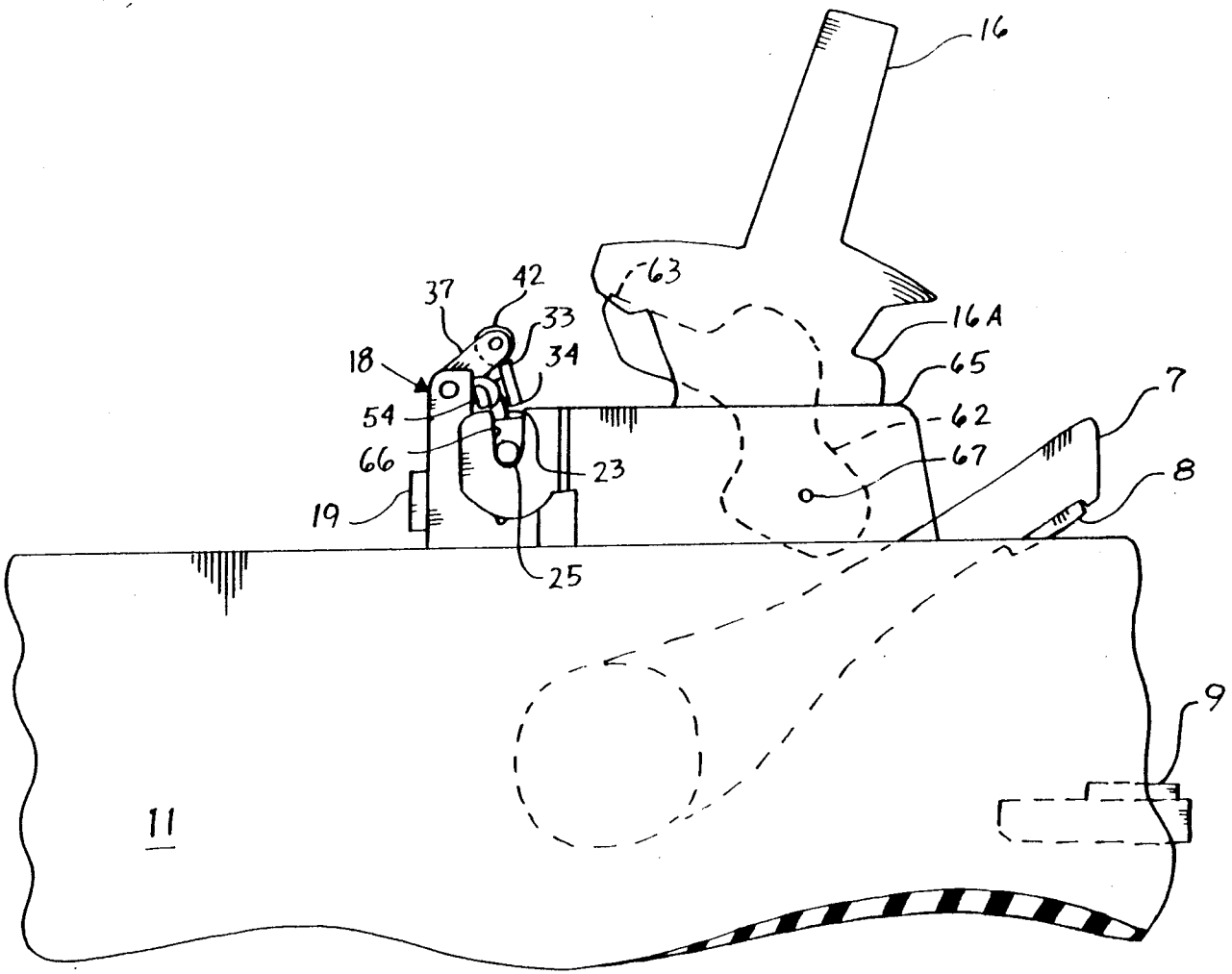
FIG. 5 is a cutaway side view of the circuit interrupter of FIG. 1 with the circuit breaker operating mechanism in a "TRIPPED" condition.

The positioning of the primary latch lever 23 between the secondary latch lever 37 arranged over the primary latch lever and the tertiary latch lever 52 arranged under the primary latch lever is best seen by referring now to the multiple latch assembly 18 shown in FIG. 4. The roller 42 on the secondary latch lever is depicted behind the upwardly-extending tab 33 held against the bias of the secondary latch lever return spring 44. The double-action torsion spring 27 interacts between the primary latch lever 23 and the tertiary latch lever 52 by means of the upwardly-extending ends 30 in contact with the primary latch lever and with the downwardly-extending loop 29 trapped behind the projection 57 on the tertiary latch lever. This position represents the so-called "UNLATCHED" condition of the multiple latch assembly 18 within the "TRIPPED" circuit interrupter 10 shown in FIG. 5.

When the multiple latch assembly 18 is mounted within the case of circuit interrupter 10 the primary latch lever 23 is accurately positioned next to the circuit interrupter cradle operator 62 by inserting the primary latch pivot pin 25, extending from opposite ends of the multiple assembly support frame 19, within the opposing pair of elongated slots 66 formed within the operating mechanism side frame 65. The operating handle 16 is depicted in the circuit interrupter "TRIPPED" condition with the cradle hook 63 at the end of the cradle operator 62 out from under the downwardly-extending tab 34 on the primary latch lever and the roller 42 on the secondary latch lever 37 away from the upwardly-extending tab 33 on the primary latch lever 23. The cradle operator 62 is pivotally attached to the circuit interrupter operating mechanism sideframe 65 by means of the cradle operator pivot 67 such that the cradle is arranged to move independently from the operating handle 16 when the cradle hook 63 is trapped beneath the downwardly-extending tab 34 on the primary latch lever 23. The multiple latch assembly 18 is in the "LATCHED" or "RESET" condition. The cradle operator then moves in unison with the operating handle 16 by operative connection with the handle yoke 16A in the manner to be described below with reference to FIGS. 6 and 7. In the circuit interrupter TRIPPED condition the movable contact arm 7 and attached movable contact 8 are separated from the fixed contact 9. The TRIPPED condition was brought about by displacement of the sidearms 54 of the tertiary latch lever by contact between the circuit interrupter actuator unit and one of the sidearms 54 of the tertiary latch lever, which side arm constitutes the circuit interrupter "trip bar" described in the aforementioned U.S. Pat. No. 4,864,263.

Figure 6:
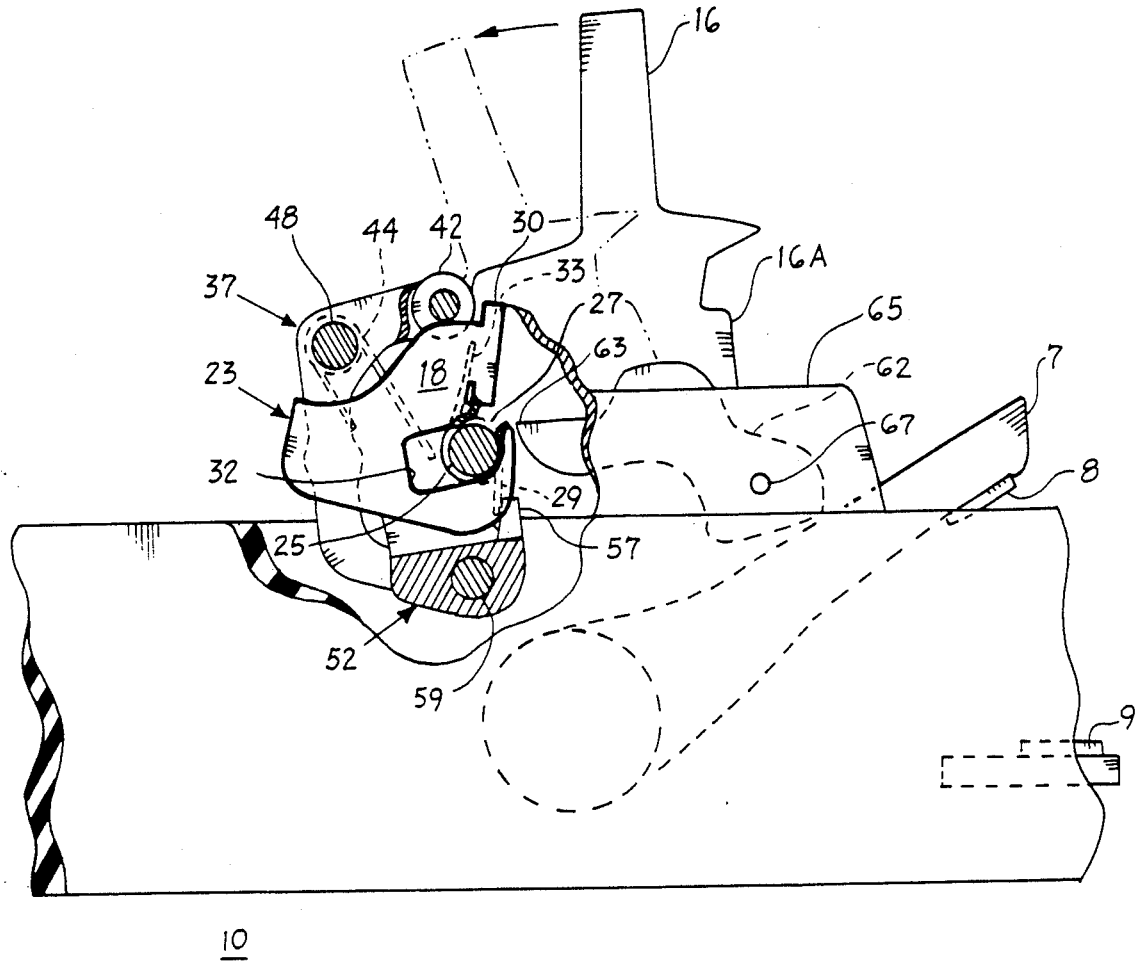
FIG. 6 is an enlarged cutaway side view of the circuit interrupter of FIG. 1 with the operating mechanism in the intermediate "RESET" condition.
Figure 7:
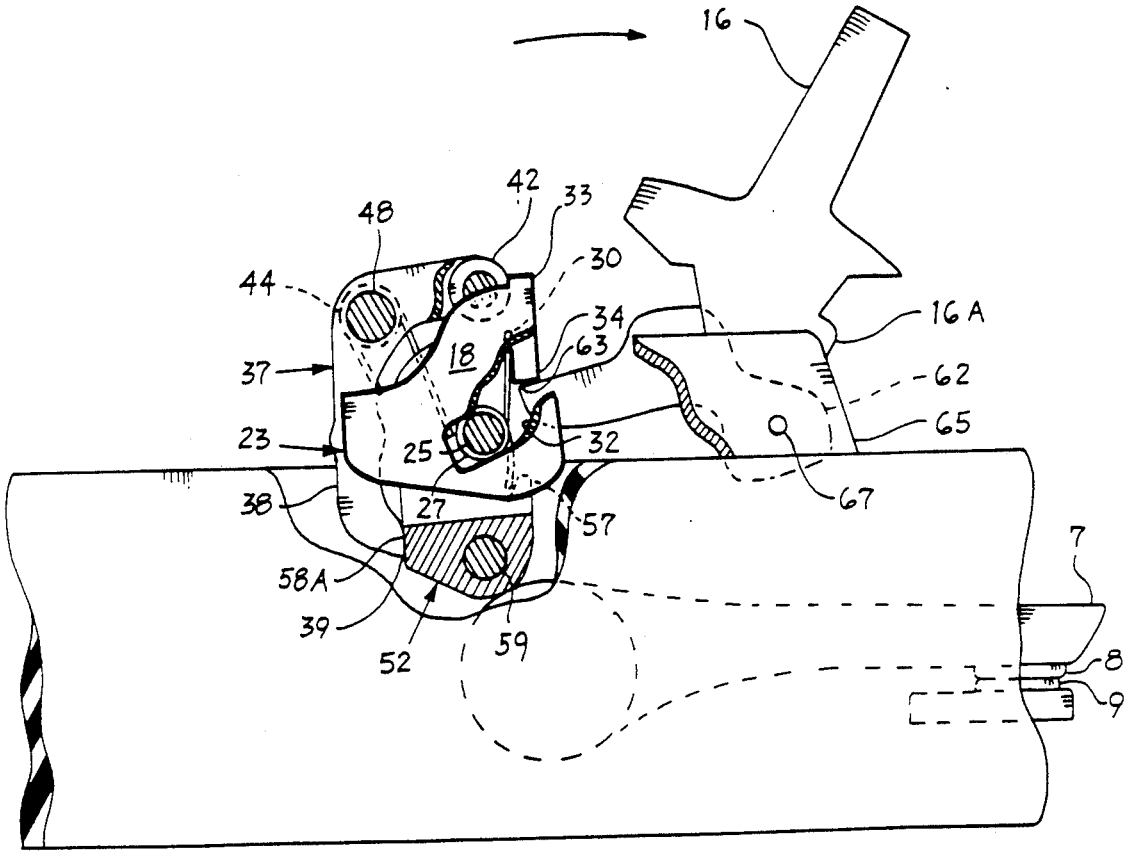
FIG. 7 is an enlarged cutaway side view of the circuit interrupter of FIG. 1 with the circuit breaker operating mechanism in a "CLOSED" condition.

The LATCHED condition of the multiple latch assembly is such that the roller 42 on the secondary latch lever 37 is held against the upwardly-extending tab 33 on the primary latch lever 23. The force of the cradle hook 63 provides the LATCHING force described earlier which force attempts to rotate the primary latch in the counterclockwise direction as viewed in FIGS. 6 and 7. Referring to FIG. 7, the planar stops 39 formed on the ends of the side pieces, one of which is shown at 38 abuts against the back surface 58A of the tertiary latch 52. When the overcurrent condition occurs, the trip bar becomes displaced by operation of the circuit interrupter trip actuator to thereby rotate the tertiary latch counterclockwise and remove the back surface 58A from the planar stops allowing the secondary latch lever 37 and roller 42 to rotate counterclockwise away from the upwardly-extending tab 33. This allows the primary latch 23 to immediately rotate counterclockwise under the large latching force provided by the cradle hook 63 and thereby articulate the circuit interrupter operating mechanism to separate the contacts 8, 9. As long as the circuit over current continues, the circuit interrupter contacts 8, 9 cannot be closed because the primary latch lever 23 is incapable of engagement with the cradle hook 63. The roller 42 on the secondary latch lever 37 in FIG. 6 is unable to remain in contact with the upwardly-extending tab 33 on the primary latch lever 23 until the planar stops again contact the blocking surface. When an attempt is later made to move the operating handle 16 and handle yoke 16A and drive the cradle operator 62 and cradle hook 63 into operative engagement with the primary latch lever after the overcurrent condition has cleared, the trip bar is no longer in contact with the actuator unit and has returned to the rest position indicated in FIG. 3 under the urgence of the return bias provided by the double-action torsion spring 27 through rotation of the tertiary latch lever 52 about the tertiary latch lever pivot pin 59.

The intermediate RESET stage of the multiple latch assembly 18 is accomplished as depicted in the circuit interrupter 10 shown in FIGS. 6 and 7 wherein the operating handle 16 is first rotated in the indicated direction to thereby move the handle yoke 16A and rotate the cradle operator 62 about the cradle pivot pin 67 on the mechanism sideframe 65 in the counterclockwise direction as viewed in FIG. 6. The cradle hook 63 on the end of the cradle operator strikes the primary latch lever 23 rotating the primary latch lever in its clockwise direction about the primary latch pivot pin 25 while, at the same time, driving the primary latch lever away from the primary latch lever pivot pin within the elongated slot 32. The roller 42 on the secondary latch lever 37 remains in contact with the upwardly-extending tab 33 on the primary latch lever as the secondary latch lever rotates a slight distance in the counterclockwise direction about the secondary latch lever pivot pin 48. The projection 57 on the tertiary latch lever 52 remains in contact with the downwardly-extending loop 29 of the double-action torsion spring 27. The primary latch 23 immediately rotates back to the latched position indicated in FIG. 7 by the automatic reset function of the multiple latch assembly 18. The cradle hook 63 at the end of the cradle operator 62 becomes trapped under the downwardly-extending tab 34 on the bottom of the primary latch lever provided that the overcurrent condition within the associated protected power distribution circuit has ceased to exist. In the event that the overcurrent condition continues, the cradle hook cannot be retained under the downwardly-extending tab thereby causing the circuit interrupter operating mechanism to again become articulated. This automatic reset function is brought about by the return bias provided by operation of the upwardly-extending legs 30 of the double-action torsion spring 2 rotating the primary latch clockwise about the primary latch lever pivot pin 25. The roller 42 on the secondary latch lever 37 remains in abutment with the upwardly-extending tab 33 as the primary latch lever 23 slides along the primary latch lever pivot pin 25 to assume the "LATCHED" position within the elongated slot 32 shown in FIG. 7. As described earlier the progression of the operating handle 16 from the TRIPPED position indicated in FIG. 5 to the intermediate RESET position indicated in phantom in FIG. 6 drives the cradle operator 62 in the counterclockwise direction about the cradle pivot pin 67 to simultaneously reset the primary latch lever 23, secondary latch lever 37, and tertiary latch lever 52 by the action of the secondary latch lever spring 44 and the double-action torsion spring 27. With the multiple latch assembly 18 in the RESET position, rotation of the operating handle 16 in the direction indicated in FIG. 7 then allows the circuit interrupter operating mechanism (not shown) to rotate the movable contact arm 7 and the attached movable contact 8 from the "OPEN" position indicated in FIG. 6 to the "CLOSED" position indicated in FIG. 7 with the movable contact 8 in abutment with the fixed contact 9.

It has thus been shown that a multi-latch assembly containing a primary latch lever, secondary latch lever, and tertiary lever automatically becomes reset to allow the latching of the circuit interrupter operating mechanism by the single operation of the circuit breaker operating handle. The controlled cooperation between the secondary latch spring and the double-action torsion spring thereby allows the circuit breaker operating mechanism to be CLOSED after the occurrence of a circuit interrupter trip operation. However, the multiple latch system only allows the circuit interrupter to return to its "CLOSED" condition when the fault causing the overcurrent condition within the protected circuit has cleared.

Having thus described our invention, what we claim as new and desire to secure by Letters Patent is:

1. A multi-latch system for molded case circuit interrupters comprising:

a support frame including means for attaching to a circuit interrupter case and recess means for supporting a latch assembly;

a primary latch lever pivotally attached to said support frame within said recess means by a first pivot pin;

a secondary latch lever pivotally attached to said support frame proximate a top part of said primary latch by a second pivot pin;

a secondary latch spring arranged about said second pivot pin biasing said secondary latch lever to a rest position;

a tertiary latch lever pivotally attached to said support frame outboard said primary latch lever by a third pivot pin; and a double-action spring arranged around said first pivot pin to allow said primary latch lever and said tertiary latch lever to automatically become reset.

2. The system of claim 1 wherein said primary latch lever comprises a first pair of opposing sidearms interconnected by a planar surface having an upwardly-extending tab arranged for contact with said secondary latch lever and a downwardly-extending tab arranged for contacting an end of said cradle operator.

3. The system of claim 1 wherein said secondary latch lever comprises a second pair of opposing sidearms having a roller at one end interconnecting between said second pair for contacting said primary latch lever upwardly-extending tab and providing increased latching force to said primary latch lever.

4. The system of claim 1 wherein said secondary latch spring comprises a torsion spring.

5. The system of claim 2 wherein each of said first sidearms includes an elongated slot and wherein said first pivot pin extends through said elongated slot.

6. The system of claim 1 wherein said tertiary lever comprises a third pair of opposing sidearms joined at one end by a crosspiece, said crosspiece including an upwardly projecting tab on one side thereof and a blocking surface on an opposite side.

7. The system of claim 1 wherein said double-action spring comprises a cylindrical winding having an upwardly-extending arm interacting with said primary latch lever and a downwardly-extending arm interacting with said tertiary latch lever.

8. The system of claim 7 including a pair of arms projecting from said third pair of sidearms, one of said arms being arranged for interacting with a circuit interrupter trip actuator.

9. The system of claim 6 including interference means on said second pair of sidearms at an opposite end from said one end, said interference means interacting with said blocking surface to prevent release of said cradle operator from said downwardly-extending tab.

10. The system of claim 6 wherein said blocking means is controlled by rotation of said third latch lever in a predetermined direction.

11. The system of claim 3 including a support pin interconnecting between said second pair of sidearms at an end opposite said one end.

12. The system of claim 11 wherein said second pivot pin extends between said second pair of sidearms intermediate said one end and said other end.

13. A circuit interrupter comprising:

a plastic case and cover;

a pair of separable contacts within said case arranged for connection with an electrical power distribution circuit;

an operating mechanism within said case arranged for automatically separating said contacts upon occurrence of an overcurrent condition through said contacts;

a support frame including means for attaching to a circuit interrupter case and recess means for supporting a latch assembly;

a primary latch lever pivotally attached to said support frame within said recess means by a first pivot pin;

a secondary latch lever pivotally attached to said support frame proximate a top part of said primary latch by a second pivot pin;

a tertiary latch lever pivotally attached to said support frame outboard said primary latch lever by a third pivot pin; and a double-action spring arranged around said first pivot pin to allow said primary latch lever and said tertiary latch lever to automatically become reset.

14. The circuit interrupter of claim 13 including a secondary latch spring arranged about said second pivot pin biasing said secondary latch lever to a rest position.

15. The circuit interrupter of claim 14 wherein said primary latch lever comprises a first pair of opposing sidearms interconnected by a planar surface having an upwardly-extending tab arranged for contact with said secondary latch lever and a downwardly-extending tab arranged for contacting an end of said cradle operator.

16. The circuit interrupter of claim 14 wherein said secondary latch lever comprises a second pair of opposing sidearms having a roller at one end interconnecting between said second pair for contacting said primary latch lever upwardly-extending tab and providing increased latching force to said primary latch lever.

17. The circuit interrupter of claim 14 wherein said secondary latch spring comprises a torsion spring.

18. The circuit interrupter of claim 16 wherein said second pivot pin extends between said second pair of sidearms.

19. The circuit interrupter of claim 14 wherein each of said first sidearms includes an elongated slot and wherein said first pivot pin extends through said elongated slot.

20. The circuit interrupter of claim 14 wherein said tertiary lever comprises a third pair, of opposing sidearms joined at one end by a crosspiece, said crosspiece including an upwardly projecting tab on one side thereof and a blocking surface on an opposite side.

21. The circuit interrupter of claim 14 including a double-action spring arranged on said first pivot pin and having an upwardly-extending arm interacting with said primary latch lever and a downwardly-extending arm interacting with said tertiary latch lever.

22. The circuit interrupter of claim 14 including a pair of arms projecting from said third pair of sidearms, one of said arms arranged for interacting with a circuit interrupter trip actuator.

23. The circuit interrupter of claim 14 including interference means on said second pair at an opposite end from said one end, said interference means interacting with said blocking surface to prevent release of said cradle operator from said downwardly-extending tab.

24. The circuit interrupter of claim 14 wherein said blocking means is controlled by rotation of said third latch lever in a predetermined direction.

* * * * *